US005344282A

United States Patent [19]

Schofield

[11] Patent Number: 5,344,282

[45] Date of Patent: Sep. 6, 1994

[54] MOLECULAR DRAG TYPE VACUUM PUMP

[75] Inventor: Nigel P. Schofield, West Sussex, England

[73] Assignee: The BOC Group, plc, Windlesham, England

[21] Appl. No.: 984,787

[22] Filed: Dec. 3, 1992

[30] Foreign Application Priority Data

Dec. 4, 1991 [GB] United Kingdom ..... 9125850

[51] Int. Cl.[5] ..... F01D 1/36

[52] U.S. Cl. ..... 415/90; 417/423.4

[58] Field of Search ..... 415/90, 200; 416/201 R, 416/201 A; 417/423.4

[56] References Cited

U.S. PATENT DOCUMENTS 2,910,223 10/1959 Schlumbohm .
3,628,894 12/1971 Ferguson, Jr. .

FOREIGN PATENT DOCUMENTS 2034285 1/1972 Fed. Rep. of Germany .
2523199 12/1976 Fed. Rep. of Germany .
3531942 4/1986 Fed. Rep. of Germany ..... 415/90
452393 3/1913 France .
2310481 12/1976 France ..... 415/90
0848762 7/1981 U.S.S.R. ..... 415/90
2003236 3/1979 United Kingdom ..... 415/90
2126653 3/1984 United Kingdom ..... 415/90

OTHER PUBLICATIONS

Harris, Nigel S., *Modern Vacuum Practice,* 1989, pp. 146–151.

*Primary Examiner*—Edward K. Look
*Assistant Examiner*—Mark Sgantzos
*Attorney, Agent, or Firm*—David M. Rosenblum; Larry R. Cassett

[57] ABSTRACT

A vacuum pump of the molecular drag type comprising a pump body, a cylindrical element adapted for rotation within the pump body about its longitudinal axis and having a plurality of circumferential slots defined in its surface which are substantially perpendicular to the longitudinal axis, a stator element held stationary with regard to the pump body and having projections extending into the slots substantially to fill the slots in the vicinity of the stator, wherein the cylindrical element comprises a co-axial assembly of a plurality of individual discs, each disc being spaced apart from its adjacent disc(s), thereby defining the circumferential slots between the discs.

8 Claims, 1 Drawing Sheet

MOLECULAR DRAG TYPE VACUUM PUMP

BACKGROUND OF THE INVENTION

This invention relates to vacuum pumps and more particularly to those pumps known as molecular drag pumps.

Molecular drag pumps operate on the general principle that, at low pressures, gas molecules striking a fast moving surface can be given a velocity component from the moving surface. As a result, the molecules tend to take up the same direction of motion as the surface against which they strike, thus urging the molecules through the pump leaving a relatively lower pressure in the vicinity of the pump inlet.

Vacuum pumps operating on the basis of this principle were proposed circa 1910 by Gaede. They generally comprised a cylinder adapted for rotation within a pump body and having a plurality of parallel slots, around its circumference. A stator element, sometimes referred to as a "comb", is supported within the body at one side of the pump and having parallel projections which fit closely within the slots, typically with a 0.1 mm clearance on all sides.

A pressure gradient is therefore established across the stator element with lower pressure on the upstream side and higher pressure on the downstream side. A pump inlet is positioned at the lower pressure side of the stator and an outlet at the higher pressure side and generally a separate pump, for example an oil pump, is connected to the outlet.

Generally the speeds of rotation of the cylinder are high, for example up to ten thousand revolutions/minute or more. In the case of relatively large machines of this type in particular, problems can arise due to the large mass of the rotor and hence of large inertia giving rise to a large amount of stored energy during rotation; this could lead to safety problems.

The invention is concerned with an improved pump design associated with the provision of a rotatable cylinder therein of lightweight construction.

SUMMARY OF THE INVENTION

In accordance with the invention, there is provided a vacuum pump of the molecular drag type comprising a pump body (or stator), a substantially cylindrical element adapted for rotation within the pump body about its longitudinal axis and having a plurality of circumferential slots defined in its surface which are substantially perpendicular to the longitudinal axis, a stator element held stationary with regard to the pump body and having projections extending into the slots substantially to fill the slots in the vicinity of the stator, wherein the cylindrical element comprises a co-axial assembly of a plurality of individual discs, each disc being spaced apart from its adjacent disc(s), thereby defining the circumferential slots between the discs.

The discs may advantageously be made of thin sheet material, preferably metal, for example aluminium or titanium or alloys thereof or stainless steel, or be made of a fibre reinforced plastic material. The discs will generally have a thickness rendering them flexible when static.

The discs advantageously have a thickness of up to 1 mm, preferably less than 0.5 mm, for example 0.25 mm, for disc diameters above 200 mm and up to 1 m diameters or more.

The invention is primarily although not exclusively aimed at disc diameters, i.e. cylindrical element diameters, above 200 mm, ideally from 300 to 750 mm. In the case of diameters less than 200 mm, the benefits of the invention, especially in terms of the lower inertia of such cylindrical elements, are not so marked and it may be beneficial in such cases to revert to a solid cylindrical element.

The cylindrical element may be assembled by mounting the discs about a shaft passing though a central aperture in each disc and spacing the discs apart from their adjacent discs by:

i) mounting spacer elements about the shaft alternately with the discs, the spacer elements being of smaller diameter than the discs to define the circumferential slots between the discs, or ii) fixing the discs to the shaft at predetermined distances apart by locating the central aperture of each disc in grooves formed in the shaft, for example either by force fitting the discs within the grooves or by other convenient means. In such cases, the shaft will generally have a larger diameter than in paragraph i) above such that in particular the shaft surfaces defines the base of the slots in the cylindrical element.

In the case of spacer elements, these preferably also have a central hole through which the shaft passes and can advantageously be made of aluminium or plastic of suitable composition.

The assembly as a whole can be secured together in any relevant manner such that it forms the cylindrical element overall with slots defined between the discs.

The cylindrical element assembly must be mounted for rotation about its longitudinal axis in a manner which allows for a fast rate of rotation and for an accurate positioning (and maintenance therein) of the axis of rotation. This can be achieved by mounting the cylindrical element on a shaft and providing a mounting of the shaft within the pump body using suitable bearings, etc.

The stator element can usefully take the form of a "comb" whose teeth represent the projections which extend into the slots of the cylindrical element. The stator element must be mounted relative to the pump body that it can be fixed in position with as small as possible a clearance between the projections and the surface walls of the slot.

It has been found that in many cases it is beneficial for the separation between the discs, i.e. the width of the slot, to increase with increasing radius of the cylindrical element. In the case of prior art solid cylindrical elements, this is achieved by having a tapered slot in the cylindrical element and a corresponding taper on the projections of the comb. In the case of the present invention, however, this is generally not possible to achieve with the thin disc assembly for the cylindrical element.

In accordance with preferred embodiments of the invention, the assembly of discs is modified by having two different sizes of disc and having discs of larger diameter spaced alternately with discs of smaller diameter, again with spacer elements of even smaller diameter between each disc or with the discs being fixed to a shaft by other means as described above.

In this way, a broader slot is defined between each larger diameter discs with narrower slots being defined at the base of each broader slot between each disc irrespective of disc size. This generally allows the smaller discs to have a reduced inertia which is beneficial in respect of stored energy and shortens the "length" of the "seal" between the stator and the outer or cylindrical element.

In general, the pumps of the invention should be operated for best results with the axis of the cylindrical element horizontal so that the discs rotate in a vertical plane at all times, especially at lower rotational speeds.

BRIEF DESCRIPTION OF THE DRAWINGS

For a better understanding of the invention and to show how it may be put into effect, reference will now be made, by way of exemplification only, to the accompanying drawings, in which.

DETAILED DESCRIPTION

Figure 1:
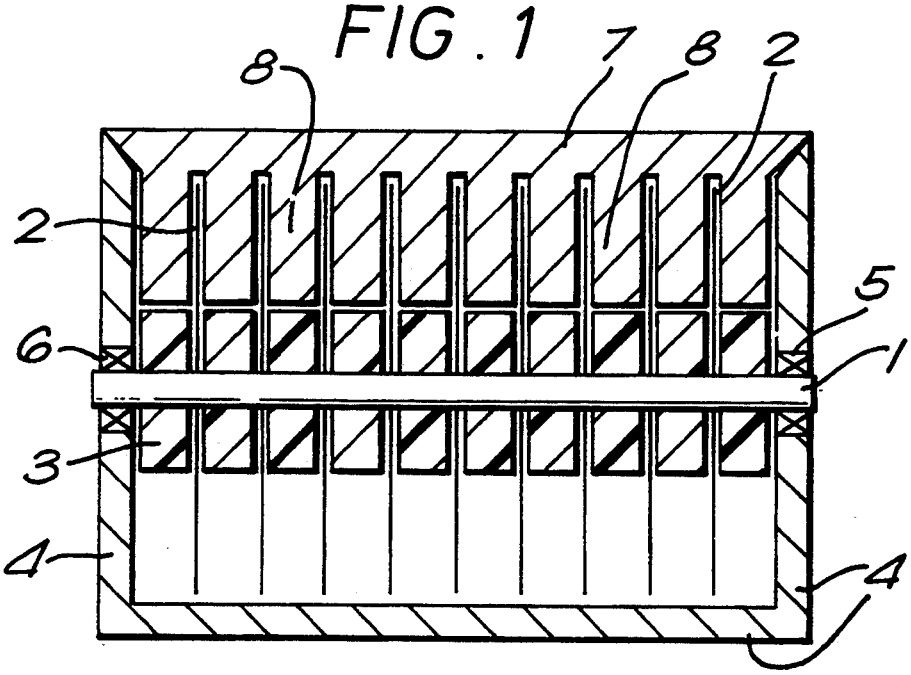
FIG. 1 shows a schematical cross-sectional view of a vacuum pump of the invention.

With reference to the drawings and to FIG. 1 in particular, there is shown a vacuum pump of the invention which comprises a shaft 1 on which is mounted a cylindrical element assembly comprising a plurality of thin discs 2 made from sheet metal (and having central holes through which the shaft passes) and spaced apart by a plurality of spacer elements 3 made from a plastic material (and also having central holes through which the shaft passes). This assembly is securely fixed together (by means not shown) to form this assembly and is mounted for rotation within the pump body 4 within bearings 5,6 in the body 4.

A stator element in the form of a comb 7 is held within the pump body and has projections 8 which extend into the slots formed between the surfaces of the discs 2 and the edges of the projections 8 of the comb 7.

Figure 2:
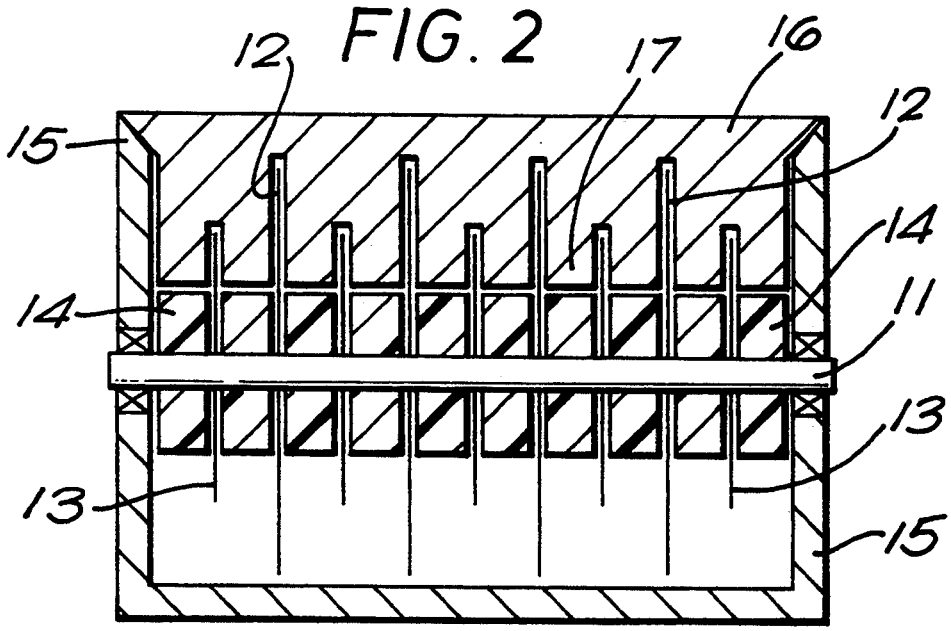
FIG. 2 shows a schematical cross-sectional view of a further vacuum pump of the invention.

Turning to FIG. 2, there is shown a further pump of the invention of somewhat different construction of cylindrical element to that shown in FIG. 1. In this case, the pump comprises a shaft 11 on which is mounted a cylindrical element comprising a plurality of thin discs 12 of larger diameter spaced alternately between a plurality of thin discs 13 of smaller diameter, all made of thin sheet metal (and having central holes through which the shaft 11 passes and being spaced apart by a plurality of plastic spacer elements 14 of diameter even smaller than that of the smaller diameter discs 13.

This assembly s securely fastened together (by means not shown) and is mounted for rotation within a pump body 15.

Again a stator element in the form of a comb 16 is held within the pump body 15 and has projections 17 which extend into slots formed between the surfaces of the alternate discs 12, 13 and the edges of the projections 17 of the comb 16.

In use of the pumps of either FIGS. 1 or 2, a motor (not shown) rotates the cylindrical element assembly about the shaft 1 so that each disc 2 is rapidly moved within the gap formed between the projections 8 of the comb 7.

As with most pumps of this type, an inlet (not shown) is positioned at the lower pressure side of the comb 7 and in use is attached to a chamber to be evacuated; an outlet (not shown) is positioned at the higher pressure side of the comb 7.

I claim:

1. A vacuum pump of the molecular drag type comprising a pump body, a cylindrical shaft rotatably mounted within the pump body for rotation about its longitudinal axis, a plurality of individual discs coaxially assembled on said shaft in a spaced apart relationship to define circumferential slots therebetween, each of said discs having a sufficiently small thickness so as to be flexible when static, and a comb-like stator element connected to the pump body so as to be held stationary with regard to the pump body and having projections extending into the circumferential slots.

2. A vacuum pump according to claim 1 in which the discs are made of sheet metal.

3. A vacuum pump according to claim 1 in which the discs are made of fibre reinforced plastic.

4. A vacuum pump according to claim 1 in which the discs have a thickness of no greater than 1 mm.

5. A vacuum pump according to claim 4 in which the discs have a thickness of less than 0.5 mm.

6. A vacuum pump according to claim 1 in which each of the discs has a central aperture and the shaft passes through the central aperture in each of the discs.

7. A vacuum pump according to claim 6 in which spacer elements are mounted about the shaft alternately with the discs, the spacer elements being of smaller diameter than the discs to define the circumferential slots between the discs.

8. A vacuum pump according to claim 7 in which the spacer elements have a central hole through which the shaft passes.

* * * * *